US006831401B1

(12) United States Patent
Yamamoto et al.

(10) Patent No.: US 6,831,401 B1
(45) Date of Patent: Dec. 14, 2004

(54) ELECTRON-EMITTING DEVICE, ELECTRON SOURCE USING THE ELECTRON-EMITTING DEVICE, AND IMAGE-FORMING APPARATUS USING THE ELECTRON SOURCE

(75) Inventors: Keisuke Yamamoto, Yamato (JP); Miki Tamura, Isehara (JP); Yasuhiro Hamamoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/513,117

(22) Filed: Feb. 25, 2000

(30) Foreign Application Priority Data

Feb. 26, 1999 (JP) ..... 11-052000
Feb. 15, 2000 (JP) ..... 2000-041453

(51) Int. Cl.[7] ..... H01J 1/62; H01J 63/04

(52) U.S. Cl. ..... 313/495; 313/310; 313/311; 313/496; 313/497; 257/86; 252/519.4

(58) Field of Search ..... 313/310, 495, 313/496, 497; 257/86; 252/519.4

(56) References Cited

U.S. PATENT DOCUMENTS

| | | | | | |
|---|---|---|---|---|---|
| 4,766,477 | A | * | 8/1988 | Nakagawa et al. | 257/64 |
| 5,196,366 | A | * | 3/1993 | Yamazaki et al. | 438/105 |
| 5,470,265 | A | * | 11/1995 | Nomura et al. | 445/24 |
| 5,578,897 | A | * | 11/1996 | Nomura et al. | 313/310 |
| 5,728,435 | A | * | 3/1998 | Geis et al. | 427/535 |
| 5,986,389 | A | * | 11/1999 | Tsukamoto | 313/310 |
| 6,169,356 | B1 | | 1/2001 | Ohnishi et al. | 313/495 |
| 6,208,071 | B1 | * | 3/2001 | Nishimura et al. | 313/495 |
| 6,410,144 | B2 | * | 6/2002 | Dearnaley et al. | 428/408 |

FOREIGN PATENT DOCUMENTS

| | | |
|---|---|---|
| EP | 0 660 357 | 6/1995 |
| JP | 7-235255 | 9/1995 |
| JP | 07-235255 | 9/1995 |
| JP | 08-273523 | 10/1996 |
| JP | 2854385 | 11/1998 |
| JP | 2000-285789 | 10/2000 |
| JP | 2001-148222 | 5/2001 |

OTHER PUBLICATIONS

M.I. Elinson et al., "The Emission of Hot Electrons and The Field Emission of Electrons From Tin Oxide", Radio Engineering and Electronic Physics, Jul. 1965, pp. 1290–1296.
M. Hartwell, "Strong Electron Emission From Patterned Tin–Indium Oxide Thin Films", IEDM, 1975, pp. 519–521.
H. Araki, "Electroforming and Electron Emission of Carbon Thin Films", Journal of the Vacuum, Society of Japan, 1983, pp. 22–29 (with English Abstract on p. 22).
G. Dittmer, "Electrical Conduction and Electron Emission of Discontinuous Thin Films", Thin Solid Films, 9, 1972, pp. 317–328.

* cited by examiner

*Primary Examiner*—Vip Patel
*Assistant Examiner*—Matt Hodges
(74) *Attorney, Agent, or Firm*—Fitzpatrick, Cella, Harper & Scinto

(57) ABSTRACT

An electron emitting device comprising: a pair of conductors opposed to each other on a substrate; and a pair of deposition films having carbon as a main component which are respectively connected to the pair of conductors and disposed with a gap therebetween. The deposition film contains sulfur in a range of not less than 1 mol % and not more than 5 mol % as a ratio to carbon.

11 Claims, 9 Drawing Sheets

ELECTRON-EMITTING DEVICE, ELECTRON SOURCE USING THE ELECTRON-EMITTING DEVICE, AND IMAGE-FORMING APPARATUS USING THE ELECTRON SOURCE

BACKGROUND OF THE INVENTION

1. Field of the Invention

The present invention relates to an electron emitting device, an electron source constituted by this electron emitting device and an image-forming apparatus which is an application thereof, and more particularly to a surface conduction electron-emitting device having a novel structure, an electron source using this device and an image-forming apparatus such as a display unit which is an application thereof.

2. Related Background Art

A surface conduction electron-emitting device utilizes such a phenomenon as that electron emission is generated by flowing an electric current through an electroconductive thin film formed on a substrate.

As an example of this surface conduction electron-emitting device, there are reported a device using an $SnO_2$ thin film [M. I. Elinson Radio Eng. Electron Phys., 10, 1290, (1965)], a device using an Au thin film [G. Ditmmer, Thin Solid Films, 9,317 (1972)], a device using an $In_2O_3/SnO_2$ thin film [M. Hartwell and C. G. Fonsted, IEEE Trans. ED Conf., 519 (1975)], a device using a carbon thin film [Hisashi Araki and et al: SHINKU (Vacuum), Vol. 26, No. 1, p. 22 (1983)] and others.

In these surface conduction electron-emitting devices, it is general to cause electron emission by performing an energization operation called "forming" with respect to the electroconductive film before carrying out electron emission.

Here, "forming" means that a fixed voltage or a voltage which slowly rises at a rate of, e.g., approximately 1V/min to both ends of the electroconductive film and an electric current is caused to flow through the electroconductive film so that the electroconductive film is locally fractured, deformed or transformed to have an electrically high resistance, thereby generating electron emission.

A fissure is formed on a part of the electroconductive film with this operation, and it can be considered that the phenomenon of electron emission occurs due to existence of this fissure. Although a position where the actual electron emission occurs is not completely cleared, the fissure and the surrounding area thereof may be referred to as "an electron-emitting region" for the sake of convenience.

The present applicant has advanced many suggestions concerning the surface conduction electron-emitting device. For example, in regard to the above- described "forming", Japanese patent No. 2854385, U.S. Pat. Nos. 5,470,265, and 5,578,897 disclose that forming is preferably carried out by application of a pulse voltage to the electroconductive film.

Here, a waveform of the pulse voltage can be appropriately selected by any of a method for maintaining a wave height value constant such as shown in FIG. 5A and a method for gradually increasing the wave height value such as shown in FIG. 5B, taking into account a shape or form of the device and a condition for forming.

Further, it has been discovered that an electric current flowing through the device (device current If) and an electric current involved by electron emission (emission current Ie) are both increased by repeatedly applying the pulse voltage to the electron-emitting device in an atmosphere containing an organic substance after the above-described forming, and this process is referred to as "an activation operation".

This operation forms a deposition containing carbon as a main component in an area including a fissure formed on the electroconductive film by "forming", and its detail is disclosed in Japanese Patent Application Laid-Open No. 7-235255.

When the above-described surface conduction electron-emitting device is applied to the image-forming apparatus and the like, low-consumption power and high brightness are further required.

Therefore, as a performance of the electron-emitting device, a ratio of the emission current Ie to the device current If, i.e., the electron-emitting efficiency needs to be higher than that of the prior art.

In order to improve such a performance, it is naturally necessary that a variation in the performance with time due to continuation of the electron emission is not larger than that in the prior art.

SUMMARY OF THE INVENTION

It is an object of the present invention to provide an electron-emitting device superior in an electron-emitting characteristic, an electron source using this device and an image-forming apparatus using this electron source.

The present invention provides an electron-emitting device comprising: a pair of conductors opposed to each other on a substrate; and a pair of deposition films containing carbon as a main component which are respectively connected to the pair of conductors and disposed with a gap therebetween, wherein the deposition film contains sulfur in a range of not less than 1 mol % and not more than 5 mol % as a ratio to the carbon.

Further, the present invention provides an electron-emitting device comprising: a pair of device electrodes opposed to each other on a substrate; an electroconductive film which is connected to the pair of device electrodes and has a fissure between the pair of device electrodes; and a deposition which is formed inside the fissure and on an area including the fissure and has a gap whose width is narrower than the fissure inside the fissure and carbon as a main component, wherein the deposition contains sulfur in a range of not less than 1 mol % and not more than 5 mol % as a ratio to the carbon.

DETAILED DESCRIPTION OF THE PREFERRED EMBODIMENTS

The present invention provides an electron-emitting device comprising: a pair of conductors opposed to each other on a substrate; and a pair of deposition films containing carbon as a main component which are respectively connected to the pair of conductors and disposed with a gap therebetween, wherein the deposition film contains sulfur in a range of not less than 1 mol % and not more than 5 mol% as a ratio to the carbon.

Further, the present invention provides an electron-emitting device comprising: a pair of device electrodes opposed to each other on a substrate; an electroconductive film which is connected to the pair of device electrodes and has a fissure between the pair of device electrodes; and a deposition which is formed inside the fissure and on an area including the fissure and has a gap whose width is narrower than the fissure inside the fissure and carbon as a main component, wherein the deposition contains sulfur in a range of not less than 1 mol % and not more than 5 mol % as a ratio to the carbon.

Furthermore, an electron source according to the present invention comprises a plurality of the electron-emitting devices provided on a substrate and a wiring connected to these electron-emitting devices.

Moreover, an image-forming apparatus according to the present invention comprises the electron source and an image-forming member for forming an image by collision of an electron emitted from the electron source.

Preferred embodiments according to the present invention will now be described in detail by means of examples with reference to the accompanying drawings. However, the scope of the present invention is not restricted to dimensions, materials, shapes, relative arrangements and others of constituent parts described in the embodiments unless otherwise stated.

Figure 1A:
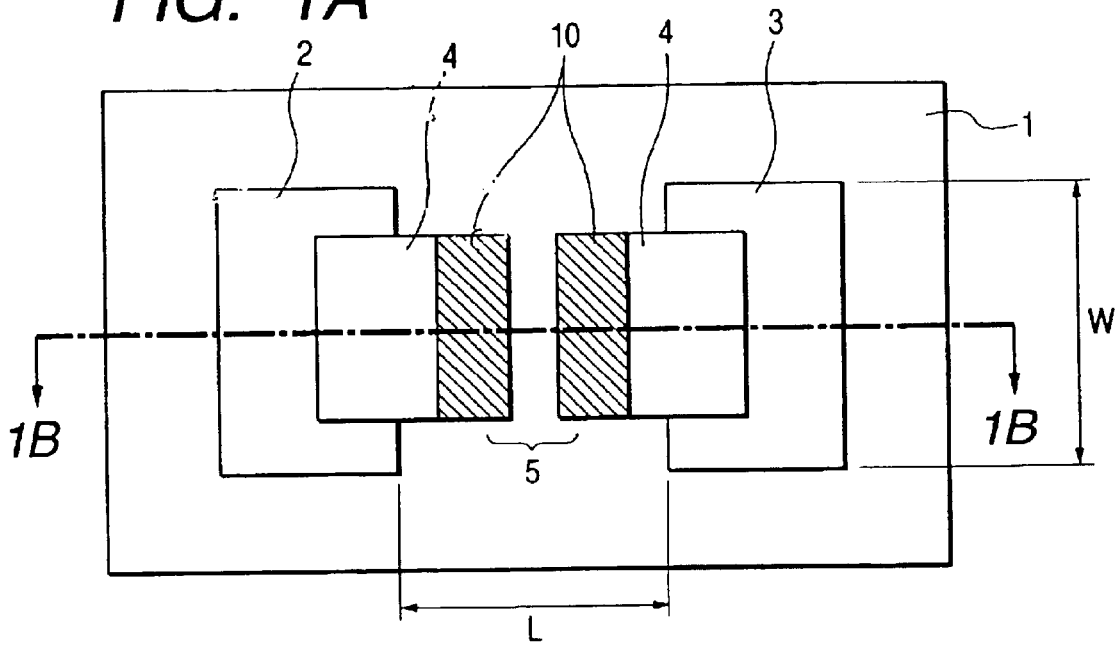
FIGS. 1A and 1B are type drawings showing a schematic structure of an electron-emitting device according to the embodiment of the present invention.
Figure 1B:
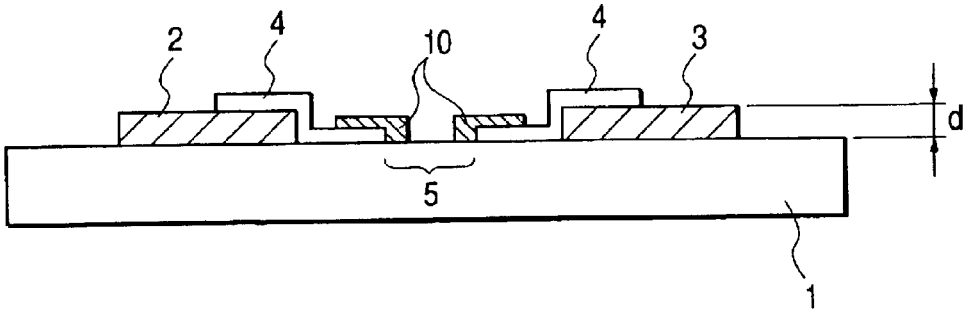

In the first place, a basic structure of an electron-emitting device according to an embodiment of the present invention will be described with reference to FIGS. 1A and 1B. FIGS. 1A and 1B are type drawings showing a schematic structure of the electron-emitting device according to the embodiment of the present invention, wherein FIG. 1A is a top plan type drawing and FIG. 1B is a cross-sectional type drawing (cross-sectional view taken along the line 1B—1B in FIG. 1A).

In FIG. 1A, reference numeral 1 denotes a substrate as a base material consisting of an insulating substance, on which substrate are provided a pair of device electrodes 2 and 3 opposed to each other, and an electroconductive film 4 is provided so as to be connected to the pair of device electrodes 2 and 3.

The illustrated example shows the case where the conductor is constituted by the device electrodes 2 and 3 and the electroconductive film 4 as described above, but the equivalent function as the electron-emitting device can be demonstrated by constituting the conductor by only the device electrodes 2 and 3 without using the electroconductive film 4.

Additionally, in the drawing, reference numeral 5 typically denotes a fissure formed on the electroconductive film 4, and this fissure 5 is provided between the pair of device electrodes 2 and 3.

Reference numeral 10 in the drawing designates a deposition (deposition film) containing carbon as a main component. Here, although the deposition 10 in the drawing is formed on only the electroconductive film 4, it may be also formed on the device electrodes 2 and 3 depending on the formation methods. The deposition 10 may be also formed on the substrate 1 at a part other than the inside of the fissure 5.

The deposition 10 containing carbon as a main component is also formed in the fissure 5 as well as around the fissure 5, and it is formed so as to form a gap narrower than the fissure 5 in the fissure 5.

Figure 2:
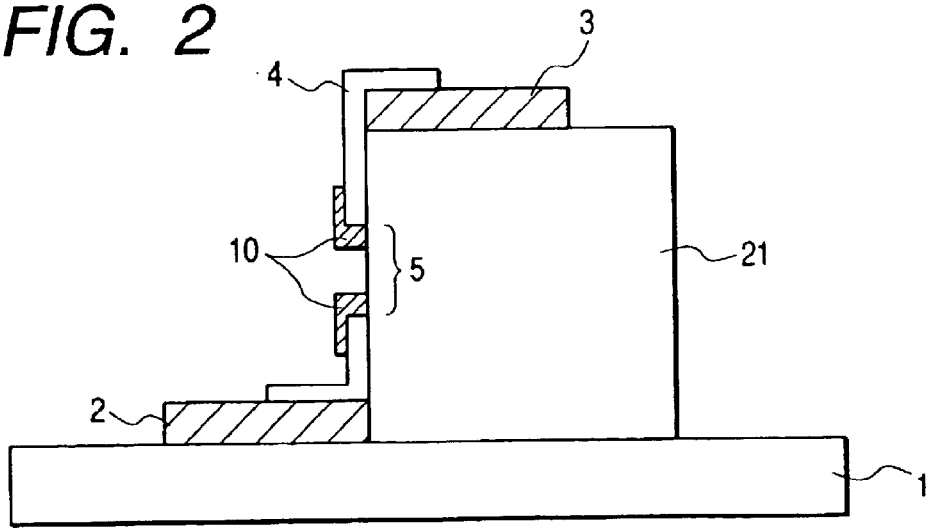
FIG. 2 is a typical cross-sectional view of the electron-emitting device according to the embodiment of the present invention.

It is to be noted that there is a step type device shown in FIG. 2 as another basic structure of the electron-emitting device. FIG. 2 is a typical cross-sectional view of the electron-emitting device according to the embodiment of the present invention.

In the drawing, reference numeral 21 represents a step-forming section consisting of an insulating substance, and this section is provided on the substrate in order to form a step. Any other basic constituent part is similar to that in FIG. 1 and hence like reference numeral is given thereto.

Here, the sufficient conductivity must be provided as a property which is necessary in the device electrodes 2 and 3, and there are metal, metal alloy, conductive metal oxides, or print conductors or semiconductors consisting of a mixture of the mentioned material and glass and the like as a substance of the device electrodes 2 and 3.

In order to preferably form a fissure by the forming, i.e., preferably impart the electron-emitting capability, it is desirable to form the electroconductive film 4 with fine particles of a conductive substance. For example, the conductive material such as Ni, Au, PdO, Pd, Pt and the like can be used as a substance of this film 4.

Above all, PdO can readily form the electroconductive film consisting of fine particles by forming an organic Pd compound film and thereafter baking it in the atmosphere. In addition, the electric conductivity of PdO is relatively lower than that of metal since it is a semiconductor, and PdO can be easily controlled in order to obtain an appropriate resistance value for the forming. Further, since PdO can be relatively easily reduced, the metal Pd can be obtained after forming the fissure by the forming, thereby reducing the resistance. Accordingly, PdO is a preferable material because it has these advantages.

The deposition 10 containing the carbon as a main component can be formed by the method of the above-described "activation".

In order to control an amount of sulfur (which will be abbreviated as S hereinbelow) contained in the deposition 10 having the carbon as a main component, there can be adopted a method by which a raw material gas containing S is led in the atmosphere including an organic substance to control its quantity when performing the activation or a method by which a liquid solution containing S in the form of an organic metal compound and the like is applied after forming the deposition and S is contained by subsequently performing heat treatment to control an application amount of the liquid solution.

According to the examination by the present inventor, it has been found that the electron-emitting efficiency can be improved when 1 mol % or more of S is contained in terms of a ratio to carbon.

On the other hand, it has been revealed that the decelerating speed of the emission current becomes disadvantageously faster than the speed obtained when no S is included (namely, the stability is lowered) when the electron is continuously emitted if the content of S is too much. In regard to this, the present inventor has found that the stability is not adversely affected in effect if the content of S is not more than 5 mol % with respect to carbon and has attained the present invention.

Although the reason for this is not sufficiently grasped, it has been apparent that at least part of the deposition containing carbon as a main component has a graphite structure, and the present inventor surmises that the conductivity is enhanced when S is contained in graphite and this fact advantageously acts on improvement of the electron-emitting efficiency. The present inventor also presumes that the reason for the adverse influence to the stability due to a large content of S relates to reduction in crystallinity in the graphite structure portion.

A further concrete example based on the embodiment according to the present invention will now be described.

(Embodiment of the Electron-emitting Device)

The electron-emitting device according to this embodiment has the structure similar to that illustrated in FIGS. 1A and 1B.

Referring to FIGS. 1A and 1B and FIGS. 3A to 3D, description will be given on a method for manufacturing the electron-emitting device according to this embodiment.

(Step-a)

A photoresist pattern is first formed on a cleaned quartz substrate 1 so as to have an opening corresponding to the shapes of the device electrodes 2 and 3, and Ti having a thickness of 5 nm and Pt having a thickness of 30 nm are sequentially deposited on this pattern by the vacuum evaporation method.

Figure 3A:
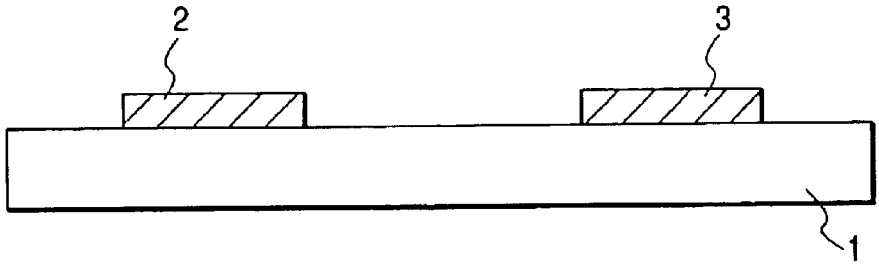
FIGS. 3A, 3B, 3C and 3D are explanatory view of steps for manufacturing the electron-emitting device according to the embodiment of the present invention.

Subsequently, the photoresist pattern is dissolved and removed by using an organic solvent, and an electrode consisting of a Pt/Ti laminated film by the lift-off technique. Here, it is determined that a gap between the electrodes L is 50 $\mu$m and a width of the electrode W is 300 $\mu\mu$m (FIG. 3A).

(Step-b)

A Cr film is so formed as to have a thickness of 100 nm by the vacuum evaporation method, and the Cr film is then patterned so as to have an opening corresponding to the shape of the later-described electroconductive film by the photolithography method. Thereafter, a liquid solution of an organic Pd compound (ccp4230 manufactured by Okuno Pharmaceutical Industries Co., Ltd.) is applied by using a spinner and the film is then subjected to the heat treatment at 350° C. in the atmosphere for 12 minutes after dried out.

With this treatment, the electroconductive film which is composed of PdO fine particles and has a thickness of 10 nm is formed. The sheet resistance Rs of this film is $2\times10^4$ Ω/□.

Incidentally, assuming that the resistance value measured by flowing an electric current through the film having the length l and the width w in the longitudinal direction is determined as R, the sheet resistance Rs is a quantity represented as R=(l/w)Rs and, if the film is uniform, it is represented as Rs=ρ/t provided that the resistivity is ρ and the film thickness is t.

(Step-c)

Figure 3B:
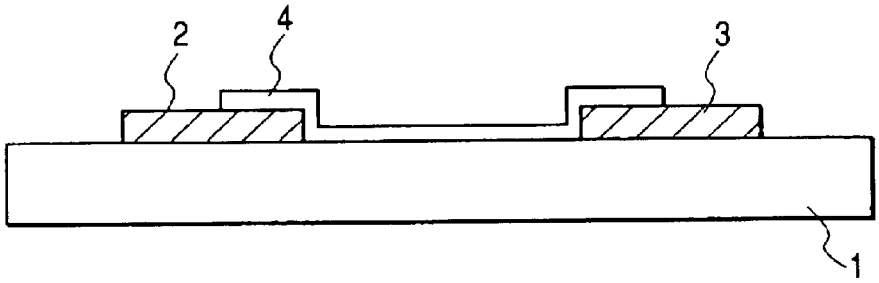

The Cr film is removed by using the Cr etchant and the electroconductive film is patterned into a desired shape by the lift-off technique (FIG. 3B).

(Step-d)

Figure 3C:
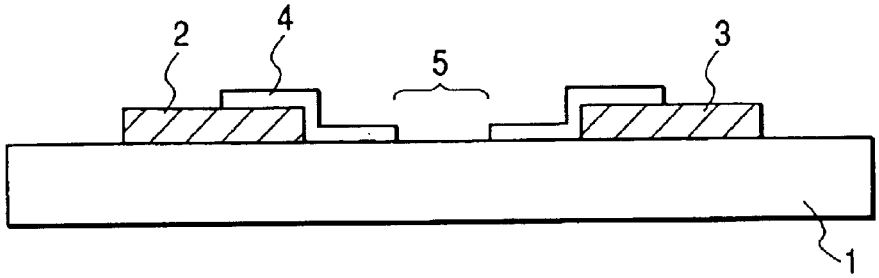

After the device is set in a vacuum operation chamber and a pressure in the vacuum chamber is reduced to $2.7\times10^{-4}$Pa by an exhauster, a pulse voltage is applied between the device electrodes 2 and 3 to perform forming and a fissure 5 is thereby formed on the electroconductive film at a part (FIG. 3C).

Figure 5A:
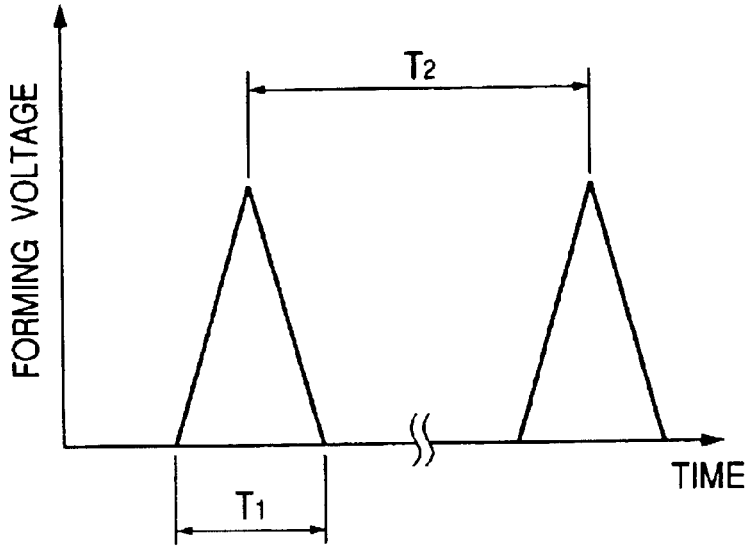
FIGS. 5A and 5B are pulse voltage waveform charts for use in a forming step when producing the electron-emitting device according to the embodiment of the present invention.
Figure 5B:
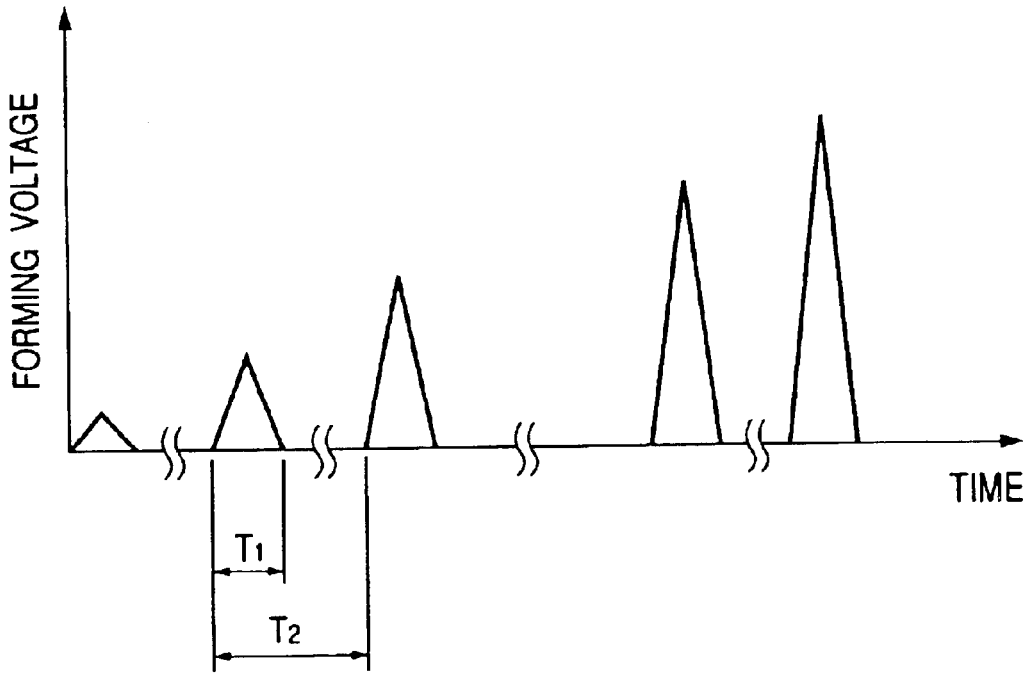

It is determined that the waveform of the pulse voltage used for the forming is as shown in FIG. 5B; the pulse width T1=1 msec.; and the pulse separation T2=10 msec., the wave height value is gradually increased at 1V increments to carry out the processing.

Incidentally, when a rectangular wave pulse having the wave height value of 0.1 V is inserted in the above-mentioned pulses during this processing to measure an electric current value, the resistance value of the device is obtained. When the thus obtained resistance value exceeds 1 MΩ, application of the pulse is stopped to terminate the forming.

(Step-e)

Subsequently, the activation step is effected. After the pressure in the vacuum chamber is lowered to $1.3\times10^{-6}$ Pa by continuing exhaust in the vacuum chamber, a mixture of benzonitrile and thiophene is led in the chamber through a slow leak valve disposed to the vacuum chamber. The slow leak valve is adjusted in such a manner that a partial pressure of benzonitrile becomes $1.3\times10^{-4}$ Pa. It is possible to control an amount of S included in the deposition having carbon as a main component, which is formed by the activation operation, by controlling a ratio of benzonitrile and thiophene.

Figure 10:
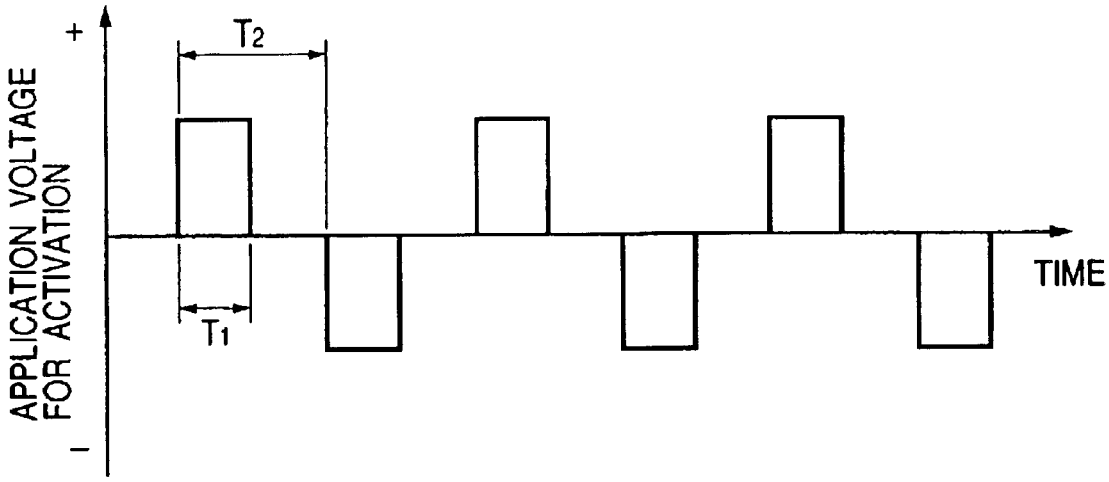
FIG. 10 is a pulse voltage waveform chart for use in an activation step when producing the electron-emitting device according to the embodiment of the present invention.

The pulse voltage is then applied between the device electrodes 2 and 3. The waveform of the applied pulse is a rectangular wave pulse such as shown in FIG. 10 whose polarity is inverted for each one pulse, and the pulse is applied for 60 minutes with the pulse width T=1 msec., the pulse separation T2=100 msec., and the pulse wave height value=15 V. (The time for applying the pulse is obtained by the preliminary examination as a time until the increase in the device current If is eased under this operation condition.)

Figure 3D:
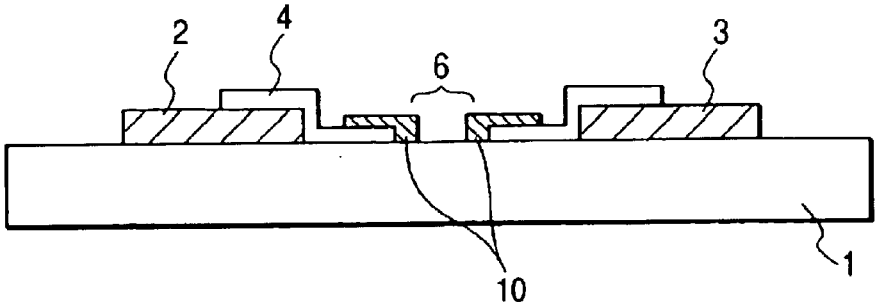

The deposition 10 having carbon as a main component is formed in an area which is formed on the electroconductive film and includes the fissure 5 by this operation. The deposition 10 having carbon as a main component is so deposited as to form a gap 6 narrower than the fissure 5 in the fissure 5 (FIG. 3D).

In this manner, samples in which an amount of S relative to carbon is 1 mol % (Embodiment 1), 3 mol % (Embodiment 2), 5 mol % (Embodiment 3), and 7 mol % (Comparative Embodiment 2) are produced. For the comparison, a sample to which no S is added (Comparative Embodiment 1) is also prepared.

Here, since the relationship between a ratio of benzonitrile and thiophene and an amount of S included in the deposition 10 having carbon as a main component differs depending on the vacuum device or conditions of the activation operation, this relationship is previously obtained by the preliminary examination and its condition is applied. At this time, a content of S is measured by the photoelectric spectrometry. The apparatus used for this measurement is ESCA LAB 220I-XL manufactured by VG Scientific.

In the measurement, a ratio of S/C is obtained based on the 2p peak of S and the 1s peak of C (carbon) observed from the area, whose length of one side is 50 $\mu$m, around the fissure. It is to be noted that the measurement limit of S under this condition is approximately 0.1 mol %.

(Step-f)

The inside of the vacuum chamber is then exhausted, and the vacuum chamber and the device are retained at 200° C. for 10 hours. Since this operation removes water or molecules of an organic substance attached to the device or the inside of the vacuum chamber, it is called "the stabilization operation".

Figure 4:
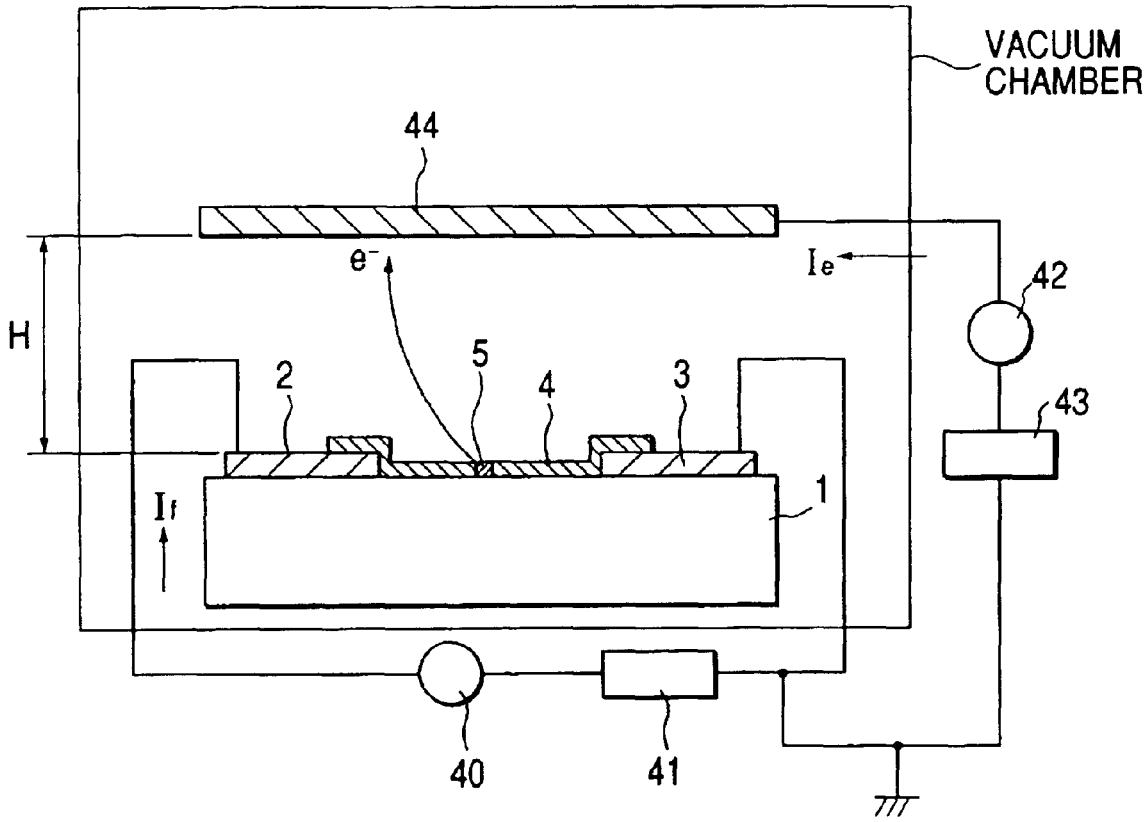
FIG. 4 is a block diagram showing an outline of an evaluation apparatus of the electron-emitting device according to the embodiment of the present invention.

The electron-emitting characteristic and its variation with time of the device are measured by using the apparatus schematically shown in FIG. 4.

That is, a pulse generator 41 is used to apply the rectangular wave pulse having the pulse width of 1 msec., the pulse separation of 100 msec. and the wave height value of 15 V to the device. It is to be noted that a distance H between the device and an anode electrode 44 is determined to be 4 mm. A constant voltage of 1 kV is applied to the anode electrode 44 by a high voltage power supply 43. Here, the device current If and the emission current Ie are measured by ampere meters 40 and 42 respectively in order to obtain the electron-emitting efficiency $\eta$=(Ie/If).

It has been found that continuation of driving the device gradually decrease both Ie and If but an increase in the content of S to some extent accelerates reduction in Ie and If as compared with the case where no S is included. Table 1 shows comparison between the values of the electron-emitting efficiency and the state of reduction in Ie and If in the initial stage of measurement.

TABLE 1

| | Comp. Embodiment 1 | Embodiment 1 | Embodiment 2 | Embodiment 3 | Comp. Embodiment 2 |
|---|---|---|---|---|---|
| S/C (mol %) | 0 | 1.0 | 3.0 | 5.0 | 7.0 |
| $\eta$ (%) | 0.12 | 0.14 | 0.14 | 0.15 | 0.15 |
| Variation with Time | — | ○ | ○ | ○ | x |

In Table 1, ○ represents that the state of reduction in Ie and If is not different from that of the sample having no S included therein (Comparative Embodiment 1), and x represents that reduction in Ie and If is faster than that of the Comparative Embodiment 1.

Consequently, when 1 to 5 mol % of S is included in the deposition having carbon as a main component, the electron-emitting efficiency is increased, and a change in Ie and If due to a variation with time is not large as compared with the case where no S is included, thereby obtaining the preferable result.

(Embodiments of the Electron Source and the Image-forming Apparatus)

When a plurality of the electron-emitting devices according to the above-described modes or embodiments of the present invention are provided on the substrate and the wiring connected to these devices is formed, an electron source can be formed.

Figure 6:
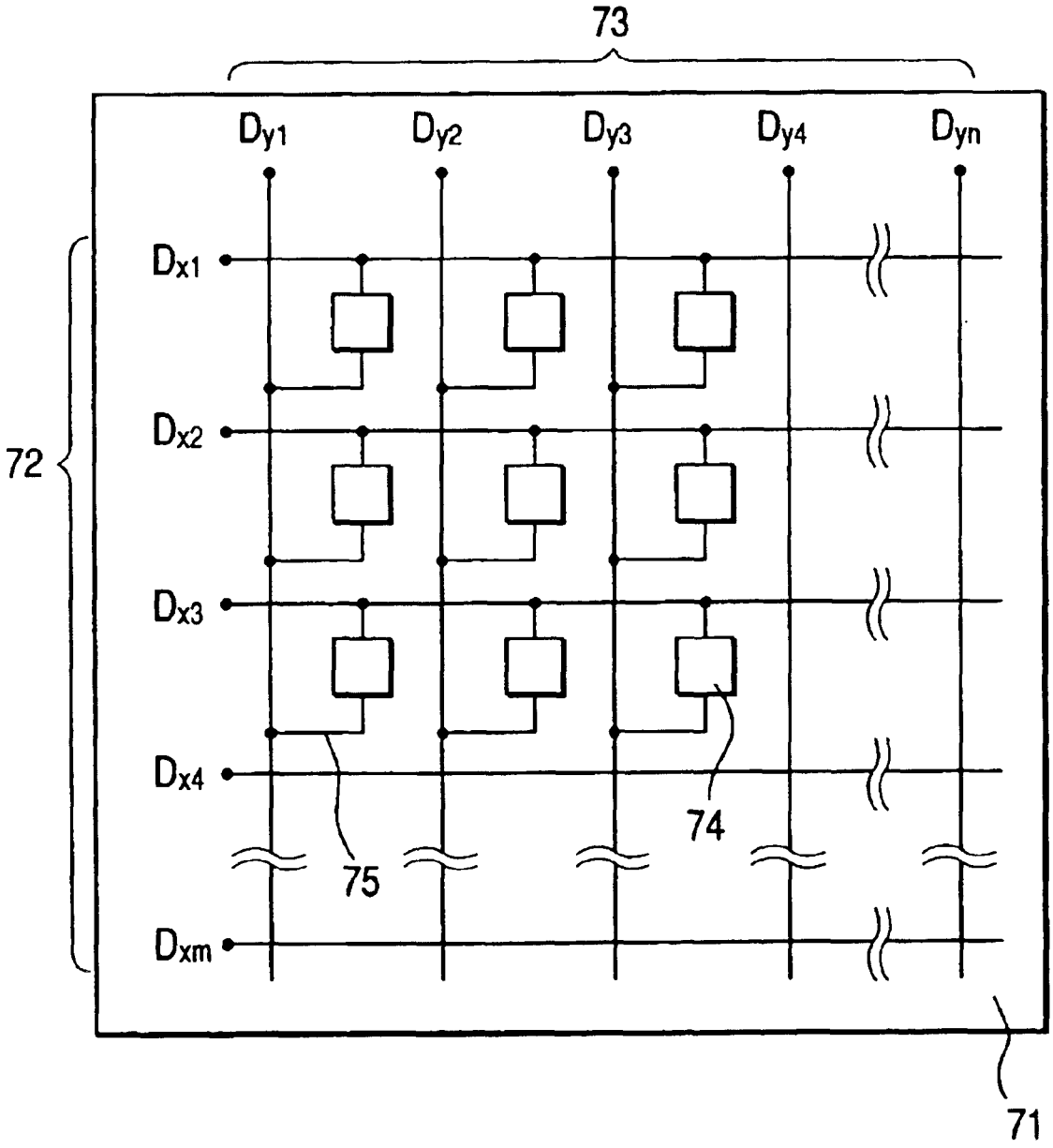
FIG. 6 is a type drawing of an electron source according to the embodiment of the present invention.

An example of the structure is shown in FIG. 6. In the drawing, reference numeral 71 denotes a substrate; 72, m X-directional wiring Dx1 to Dxm; 73, n Y-directional wiring Dy1 to Dyn; 74, an electron-emitting device according to the modes or embodiments of the present invention; and 75, a wire connection connecting the wiring to the devices. A non-illustrated insulation layer is provided at an intersection of the X-directional wiring and the Y-directional wiring in order to electrically insulate them.

Further, an image-forming apparatus can be constituted by the electron source and an image-forming member for forming an image by irradiation of an electron emitted from the electron source.

Figure 7:
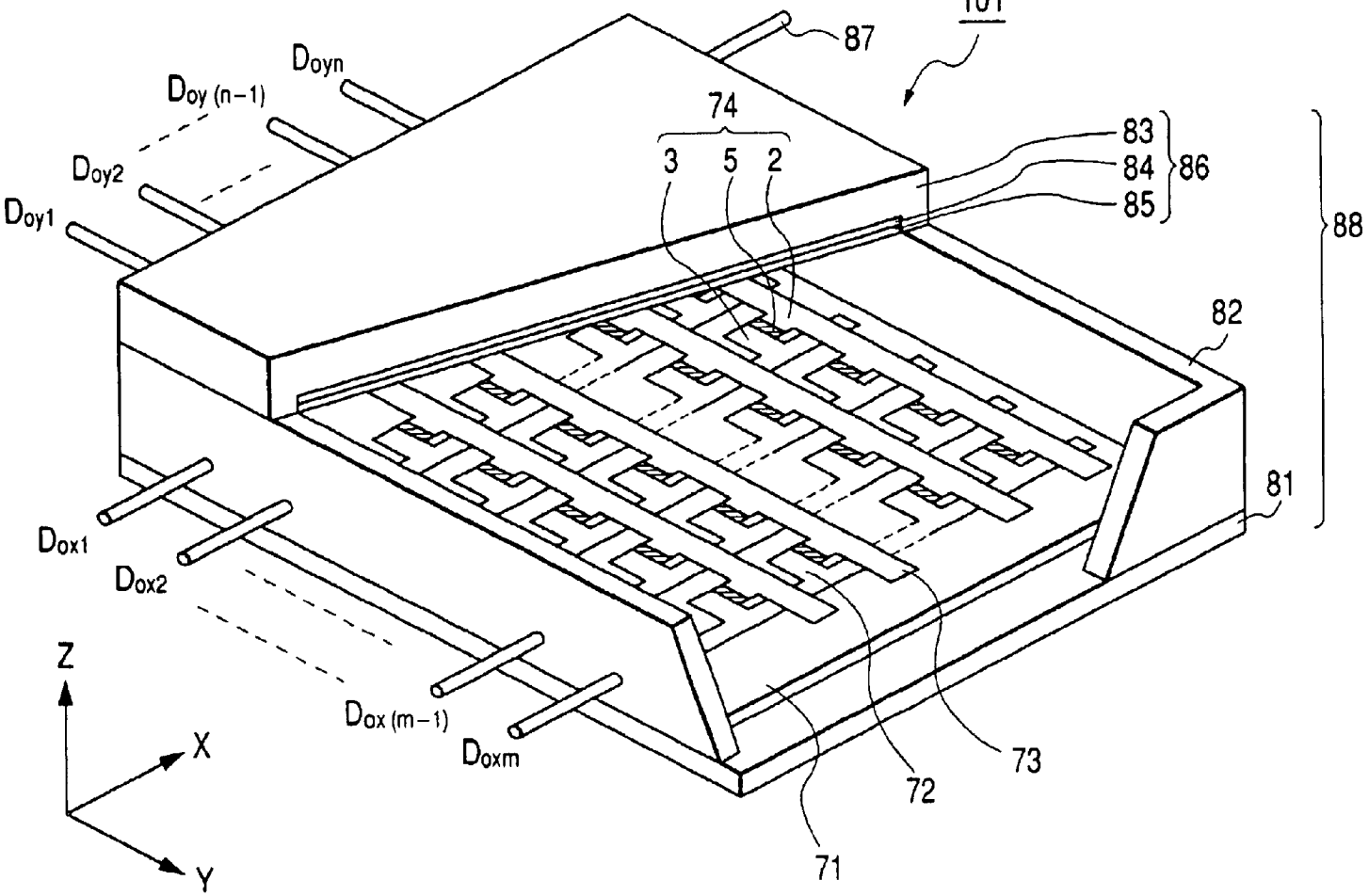
FIG. 7 is a typical partially broken perspective view of an image forming apparatus using the electron source depicted in FIG. 6.

FIG. 7 shows an example of the structure. In the drawing, reference numeral 81 designates a rear plate; 82, a supporting frame; 83, a glass substrate; and 86, a face plate. These members constitute an envelope 88. The above-mentioned electron source is provided inside the envelope 88, and the inside of the envelope can be held in the airtight manner.

Reference characters Dox1 to Doxm and Doy1 to Doyn denote external terminals connected to the X-directional wiring Dx1 to Dxm and the Y-directional wiring Dy1 to Dyn, respectively. Reference numeral 84 represents an image-forming member constituted by phosphor and the like; 85, a metal back composed of a metal evaporated film and the like. The metal back 85 outwardly reflects a light ray emitted from the image-forming member 84 toward the inside of the envelope 88 to improve the brightness and functions as an anode electrode for accelerating the electron emitted from the electron source.

Reference numeral 87 designates a high voltage terminal connected to the metal back 85, and this terminal is connected to a power supply for applying a high voltage to the metal back (anode electrode) 85.

Although the rear plate 81 and the substrate 71 for the electron source are separately provided in the illustrative example, the substrate 71 may also serve as the rear plate when the substrate 71 has the sufficient strength.

Figure 8:
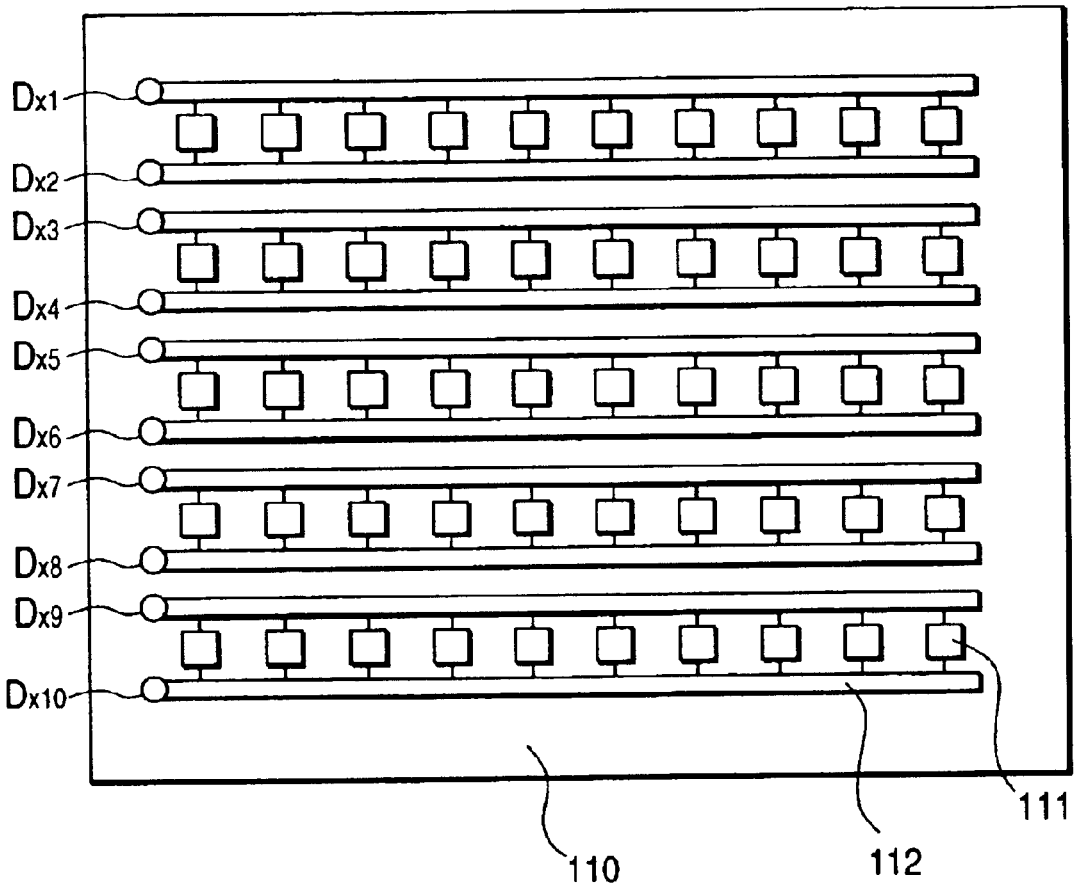
FIG. 8 is a type drawing showing another structure of the electron source according to the embodiment of the present invention.

As the structure of the electron source, a structure such as shown in FIG. 8 can be also adopted. That is, a plurality of wiring 112 are formed on the substrate 110 in parallel to each other, and a plurality of the electron-emitting devices 111 are disposed between a pair of wiring to form a plurality of device rows.

Figure 9:
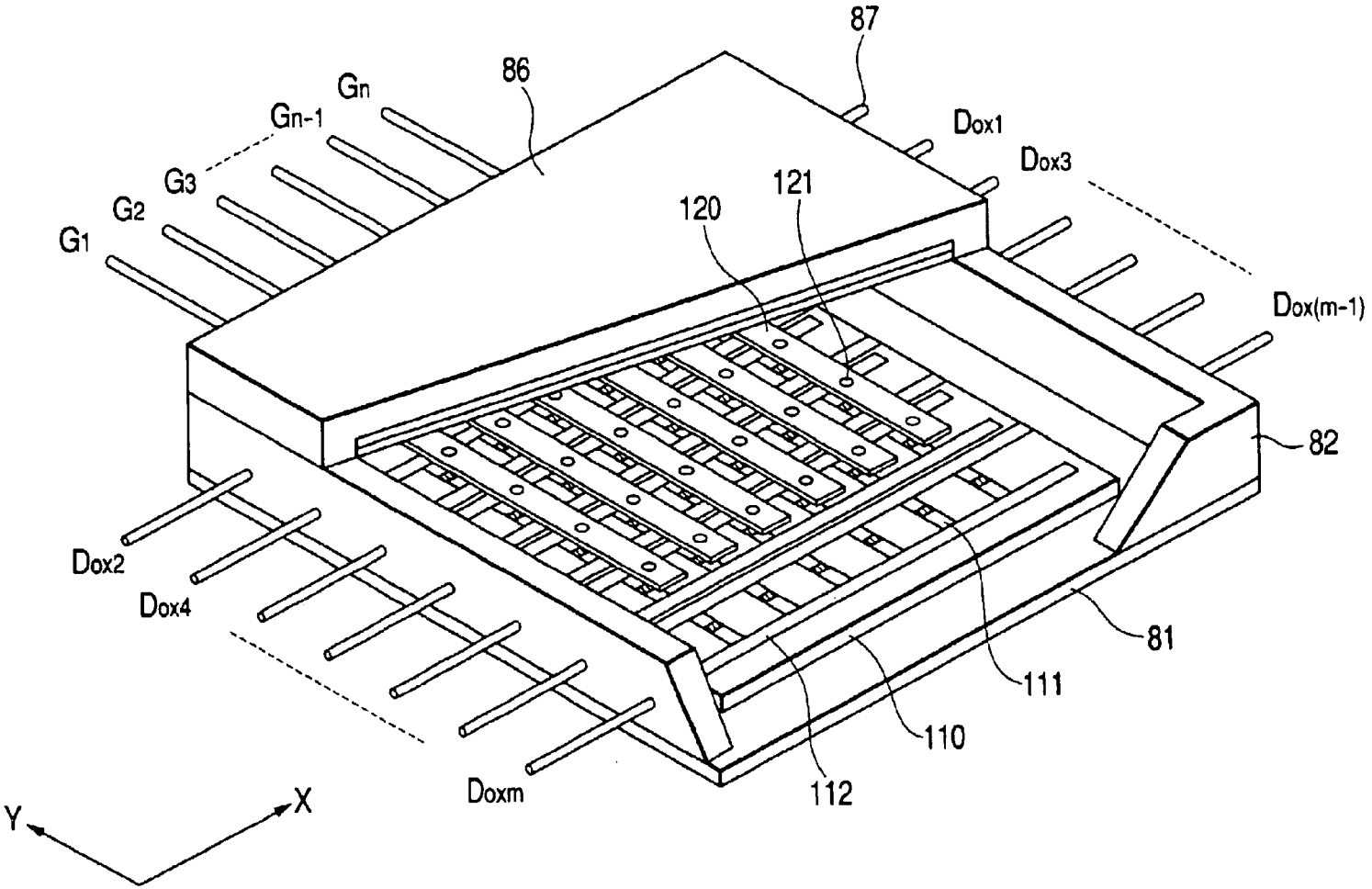
FIG. 9 is a typical partially broken perspective view of an image-forming apparatus using the electron source depicted in FIG. 8.

FIG. 9 shows an example of the structure of an image-forming apparatus using the electron source having such an arrangement. In case of this structure, a plurality of grid electrodes 120 which is elongated in a direction orthogonal to a direction of the device rows of the electron source are provided, and they have a function for modulating an electron beam emitted from the electron-emitting device belonging to one row in the plural device rows selected by a drive circuit.

Each grid electrode has an electron transmitting hole 121 for transmitting an electron therethrough at a position corresponding to the electron-emitting device.

Reference characters Dox1 to Doxm denote external terminals connected to the wiring. In the drawing, the odd-numbered wiring and the even numbered wiring are taken out from the side surface of the supporting frame on the opposed side. Reference characters G1 to Gn designate grid external terminals connected to the respective grid electrodes.

As described above, the present invention can improve the electron-emitting efficiency to the extent that a variation with time due to driving is not adversely affected by including sulfur in the deposition film having carbon as a main component in a range of not less than 1 mol % and not more than 5 mol % as a ratio to carbon.

What is claimed is:

1. An electron-emitting device comprising:

a pair of conductors provided on a substrate so as to be opposed to each other; and a pair of films containing carbon as a main component which respectively connected to the pair of conductors and disposed with a gap therebetween, wherein sulfur is contained in the deposition film in a range of not less than 1 mol % and not more than 5 mol % as a ratio to carbon.

2. An electron-emitting device comprising:

a pair of device electrodes provided on a substrate so as to be opposed to each other;

an electroconductive film which is connected to the pair of device electrodes and has a fissure between the pair of device electrodes; and a film containing carbon as a main component which is formed in the fissure and on an area including the fissure and has a gap whose width is narrower than the fissure in the fissure, wherein sulfur is contained in the film containing carbon in a range of not less than 1 mol % and not more than 5 mol % as a ratio to carbon.

3. An electron source comprising:

a plurality of electron-emitting devices as defined in claim 1 or 2 which are provided on a substrate; and a wiring connected to a plurality of the electron-emitting devices.

4. An image-forming apparatus comprising:

an electron source as defined in claim 3; and an image-forming member for forming an image by collision of an electron emitting from the electron source.

5. An electron-emitting device comprising:

a carbon film composed mainly of carbon, and an electrode electrically connected to the carbon film, wherein sulfur is contained in the carbon film in a ratio of from 1 mol % to 5 mol % with respect to carbon.

6. An electron-emitting device comprising:

a pair of device electrodes disposed on a substrate so as to face each other;

an electroconductive film connected to the pair of device electrodes and having a first gap between the pair of device electrodes; and a film containing carbon as a main component, said carbon film being disposed on the electroconductive film and having a second gap, located within the first gap, said second gap being narrower in width than the first gap, wherein sulfur is contained in the carbon film in a ratio of from 1 mol % to 5 mol % with respect to carbon.

7. An electron source comprising a plurality of electron-emitting devices according to claim 5 or 6, wherein said devices are disposed on a substrate, and wirings connected to said electron-emitting devices.

8. An image-forming apparatus comprising an electron source according to claim 7, and an image forming member.

9. An electron-emitting device comprising:

a carbon film composed chiefly of carbon; and an electrode electrically connected to the carbon film, wherein sulfur is contained in the carbon film in a rate of 1 mol % or more with respect to carbon.

10. An electron source comprising:

a substrate;

a plurality of electron-emitting devices disposed on the substrate, each electron-emitting device being an electron-emitting device according to claim 9; and wirings connected to the electron-emitting devices.

11. An image-forming apparatus comprising an electron source according to claim 10, and a phosphor.

* * * * *

UNITED STATES PATENT AND TRADEMARK OFFICE

CERTIFICATE OF CORRECTION

PATENT NO. : 6,831,401 B1
DATED : December 14, 2004
INVENTOR(S) : Keisuke Yamamoto et al.

It is certified that error appears in the above-identified patent and that said Letters Patent is hereby corrected as shown below:

Title page,
Item [56], References Cited, FOREIGN PATENT DOCUMENTS,
"JP 7-235255 9/1995" should be deleted.
Item [57], ABSTRACT,
Line 1, "electron emitting" should read -- electron-emitting --.

Column 2,
Line 57, "view" should read -- views --.

Column 4,
Lines 15 and 17, "be also" should read -- also be --.

Column 5,
Line 50, "300 $\mu\mu$m" should read -- 300 $\mu$m --.

Column 7,
Line 22, "100 msec." should read -- 100 msec., --.

Column 8,
Line 41, "be also" should read -- also be --.

Column 10,
Line 2, "carbon," should read -- carbon; --.

Signed and Sealed this

Twentieth Day of September, 2005

JON W. DUDAS
*Director of the United States Patent and Trademark Office*